US007624982B2

(12) United States Patent
Christl et al.

(10) Patent No.: US 7,624,982 B2
(45) Date of Patent: Dec. 1, 2009

(54) APPARATUSES FOR PROCESSING SHEET MATERIAL

(75) Inventors: Rudolf Christl, München (DE); Ralf Hobmeier, München (DE); Michael Stapfer, München (DE)

(73) Assignee: Giesecke & Devrient GmbH, Müchen (DE)

( * ) Notice: Subject to any disclaimer, the term of this patent is extended or adjusted under 35 U.S.C. 154(b) by 217 days.

(21) Appl. No.: 10/577,244

(22) PCT Filed: Oct. 25, 2004

(86) PCT No.: PCT/EP2004/012033

§ 371 (c)(1),
(2), (4) Date: Apr. 5, 2007

(87) PCT Pub. No.: WO2005/043472

PCT Pub. Date: May 12, 2005

(65) Prior Publication Data

US 2007/0272730 A1 Nov. 29, 2007

(30) Foreign Application Priority Data

Oct. 28, 2003 (DE) ..... 103 50 120

(51) Int. Cl.
*B65H 39/10* (2006.01)

(52) U.S. Cl. ..... 271/303

(58) Field of Classification Search ..... 271/303
See application file for complete search history.

(56) References Cited

U.S. PATENT DOCUMENTS 4,373,713 A * 2/1983 Loebach ..... 271/303
4,420,153 A 12/1983 Winkler et al.
4,697,071 A 9/1987 Hiraoka et al.
4,871,163 A * 10/1989 Landa et al. ..... 271/225
5,806,650 A 9/1998 Mennie et al.
5,815,592 A 9/1998 Mennie et al.
6,176,485 B1 * 1/2001 Wingate ..... 271/303
6,550,621 B2 4/2003 Fukatsu et al.
2005/0179198 A1 * 8/2005 Biegelsen et al. ..... 271/303

FOREIGN PATENT DOCUMENTS

| | | |
|---|---|---|
| CA | 2 141 467 | 8/1995 |
| CA | 2 245 160 | 8/1997 |
| DE | 44 02 624 | 6/1994 |
| DE | 296 15 385 | 1/1997 |
| DE | 695 15 836 | 3/2000 |
| DE | 102 10 687 A1 | 10/2003 |
| EP | 0 721 846 | 7/1996 |
| EP | 1 199 681 A2 | 4/2002 |

* cited by examiner

*Primary Examiner*—David H Bollinger
(74) *Attorney, Agent, or Firm*—Bacon & Thomas, PLLC

(57) ABSTRACT

An apparatus for processing sheet material includes a transport device for transporting single sheets of the sheet material. The transport device includes a diverting device for diverting the transport direction of the single sheets having one or more opposite first and second diverting elements between which the sheets are transported through for diversion. One of the diverting elements has a roughened surface with depressions of at least 1 mm. The apparatus further includes a smoothing device arranged so as to pull apart the sheet material in a direction perpendicular to the transport direction immediately before diversion in the diverting device.

10 Claims, 3 Drawing Sheets

APPARATUSES FOR PROCESSING SHEET MATERIAL

FIELD OF THE INVENTION

This invention relates to apparatuses for processing sheet material, such as bank notes.

BACKGROUND

Such apparatuses can be used for counting and/or sorting or for depositing and/or dispensing bank notes. For example, DE 102 10 687 A1 from the applicant de-scribes such an apparatus for depositing bank notes. The bank notes inserted in stacked form into an input pocket are singled, then transported through a curved aligning path, and subsequently checked for authenticity, nominal value and optionally fitness in a sensor module. The accepted bank notes are then transported to an escrow, such as a film storage, and the non-accepted, so-called reject, bank notes output to the operator again.

If the operator finally confirms the end of the pending deposit operation, all bank notes are transported from the buffer to an end cashbox, such as a bank note cassette placed in a safe, and the retained amounts credited to an account assigned to the operator. Upon an abort of the pending transaction, on the other hand, all bank notes are output from the buffer to the operator again.

This apparatus has, among other things, a gate module functioning as a diverting device, which has a plurality of transport channels for interconnecting the input, output, escrow and end cashbox alternatively by switching associated gate vanes. Transport and diversion at the nodal points of the gate module is effected with the help of pairs of rollers between which the bank notes to be transported and diverted are conveyed and diverted by the gate vane.

It has turned out that disturbances in the functional flow of the apparatus can occur because the transport of input bank notes within the apparatus cannot always be reliably detected, or jams occur in particular during diversion of bank notes in the gate module.

SUMMARY

On these premises, it is the problem of the present invention to modify a processing apparatus as described for example in DE 102 10 687 A1 so as to reduce the probability of occurrence of errors during the operation of the apparatus.

A first idea of the present invention is that the diverting device itself should have means for transporting even poor-quality sheets through between the diverting elements without jamming. Since said means are provided precisely where jams are very likely to occur, namely at the diverting points themselves, in particular at transport nodes of a gate, the processing of even poor-quality sheet material is facilitated. The means can be an integrated part of the diverting device, the latter advantageously being a separate component which can be removed from the processing apparatus for trouble-shooting or for maintenance purposes.

According to a preferred embodiment, diverting elements, such as diverting rollers of a gate, will have a roughened surface to avoid jamming during diversion. The surface should have depressions of at least 1 mm, preferably at least 2 mm. The roughening of the surface of the diverting elements causes the sheets to adhere better thereto and thus be more easily diverted.

According to a further advantageous embodiment, the diverting element can also be a paddle wheel with outwardly protruding paddle elements. The use of paddle wheels has the advantage that the arriving sheet material can be pulled along by rotation of the paddle wheel toward a diverting point in the transport path of the diverting device, which likewise permits a reliable diversion of even poor-quality sheet material and thus a prevention of jams.

Further, the means for preventing jams can also consist in the diverting element being rotatably mounted and either being formed completely from an elastic material or having at least an elastically deformable surface area which is deformed upon rotation of the diverting element complementarily to the form of an opposite diverting element such that a large-area contacting of the sheets to be diverted is given upon transport of the bank note to be diverted through between the elastically deformed and the opposite harder diverting element.

Moreover, a means can preferably be provided as part of the diverting device for smoothing the directly following sheets to be diverted, by which at least the leading edge of the sheet material is pulled apart immediately before the diversion in a direction perpendicular to the transport direction. Said smoothing means can in particular have conically formed pressure rollers with an elastic surface, as e.g. described in EP 1 199 681 A2.

Because the inventive smoothing means is provided only immediately before the particularly jam-prone diversion in the gate and e.g. not directly after the singler in the processing apparatus, however, a contribution is made to preventing a jam especially of those bank notes that are only creased or folded in the apparatus itself due to errors during transport from the singler to the gate.

According to a further independent idea of the present invention, in the case of a transport path in which bank notes are first aligned and then transported further in the aligned state, a monitoring of the sheet position by means of light barriers will only be carried out after traversal of the aligning path. The monitoring can be used for ascertaining transport disturbances and/or for controlling the apparatus 1 in time coordination with the actual position of the bank notes in transport.

When said position monitoring is otherwise effected by means of light barriers e.g. already before the bank notes traverse the aligning device, it might in some cases happen that certain bank notes are not recognized. This problem has arisen in particular with polymer bank notes having see-through windows, since with the light barrier mounted immediately after the singler it has happened that the light barrier for transport monitoring has shone precisely through such a see-through window due to the possible lateral offset of the bank notes not yet aligned. Depending on the form of said see-through windows and the data read cycle of the light barrier, problems have sometimes occurred in the recognition of the bank notes in such cases.

Since said transport monitoring is now carried out according to the invention only after an alignment of the bank notes, a defined sheet running plane of the bank notes is reliably given, so that the associated light barriers can preferably be disposed in an area where the bank notes normally to be checked do not have a see-through window. This consequently permits reliable transport monitoring, in particular with bank notes having see-through windows.

BRIEF DESCRIPTION OF THE DRAWINGS

Further advantages of the present invention will result from the following description of preferred embodiments with reference to the enclosed figures. These show.

DETAILED DESCRIPTION OF VARIOUS EMBODIMENTS

Figure 1:
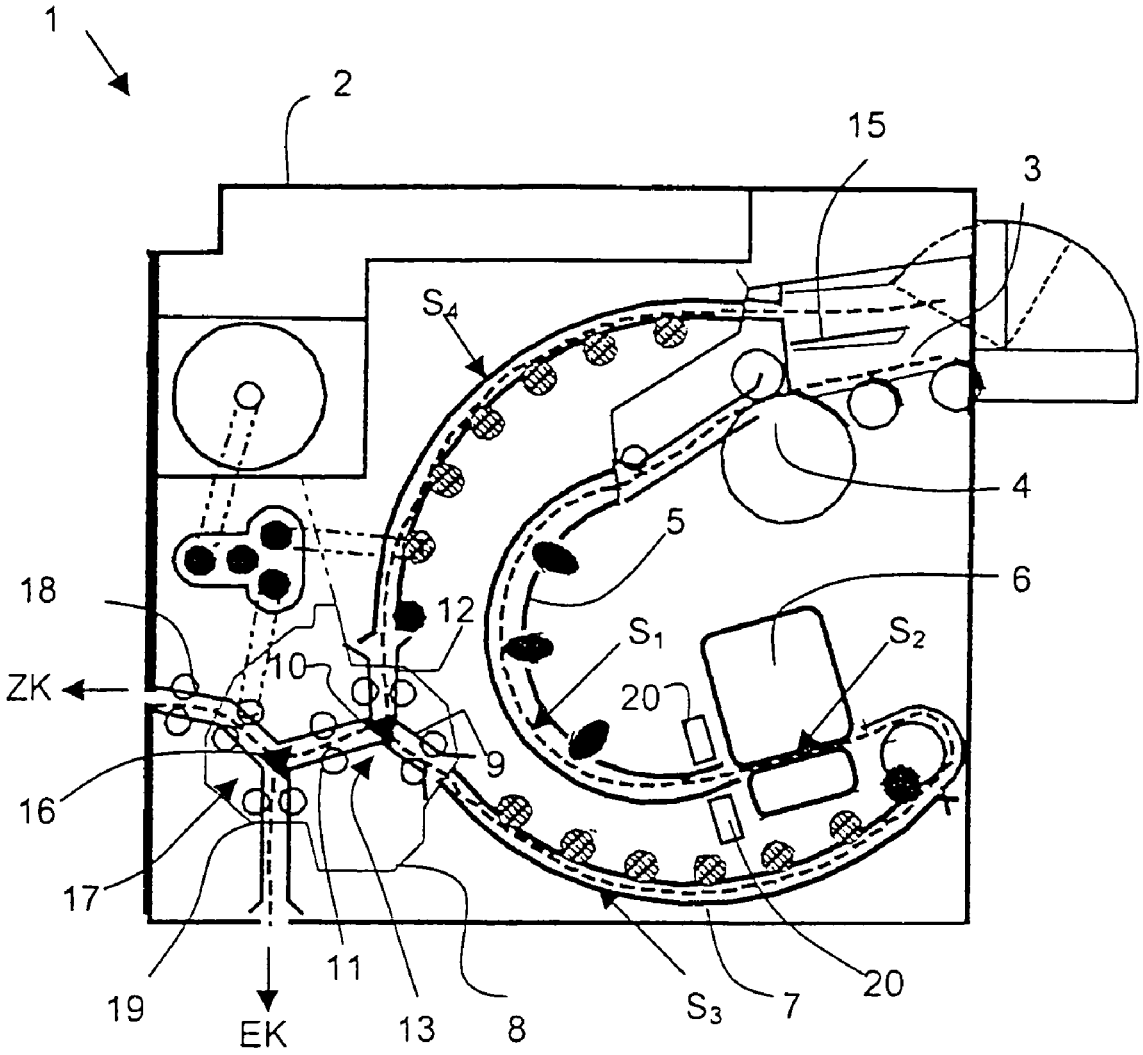
FIG. 1 a schematic cross-sectional view of part of a cash deposit apparatus according to a first embodiment of the present invention.

FIG. 1 shows part of a bank note processing apparatus 1. The apparatus 1 is constructed, except for the differences specified more exactly hereinafter, like the cash deposit apparatus described in detail in DE 102 10 687 A1 from the applicant. The apparatus 1 specifically comprises in a basic module 2, among other things, an input pocket 3 for inputting a loose stack of bank notes to be deposited. After singling by a singler 4 the bank notes are aligned by means of an alignment unit 5 with obliquely mounted transport rollers along a curved aligning path $S_1$ laterally against a stop edge extending in the transport direction. After traversal of the aligning path $S_1$ the bank notes are passed through a sensor path $S_2$ having parts of a checking unit 6 mounted on the opposite sides thereof for checking the bank notes for authenticity, nominal value and optionally fitness. After traversal of the sensor path $S_2$ the bank notes are transported by means of a downstream transport unit 7 along a further transport path $S_3$ to a gate module 8 as the diverting device.

The gate module 8, whose detailed description in DE 102 10 687 A1 is hereby expressly referred to, has a plurality of transport channels which are formed by opposite transport surfaces with meshing pairs of rollers between which the bank notes are transported through. A first transport channel 9 is connected to the transport path $S_3$ and opens into a gate node as the diverting point 13 from which two further transport channels 11 and 12 branch off. By mechanical displacement of a gate element 10 at the diverting point 13 the bank notes categorized as non-accepted in the checking unit 6, such as the bank notes not recognized, are passed on via the transport channel 12 to a transport path $S_4$ which opens into the pocket 3 again in which the non-accepted, so-called reject, bank notes are output again on a vertically adjustable base plate 15.

All bank notes recognized and accepted by the checking unit 6, on the other hand, are diverted to the other transport channel 11 at the diverting point 13 of the gate module 8 by corresponding displacement of the gate vane 10. By displacement of a second gate vane 16 the bank notes are then diverted at a further diverting point 17 to the transport channel 18 which leads to an escrow module ZK, which for clarity's sake is not shown and can be designed e.g. as a film storage, for storing the deposited bank notes temporarily until the end of a pending transaction.

After all bank notes deposited during a pending transaction have thus been either output again to the pocket 3 as reject bank notes or transported to the escrow ZK as accepted bank notes, the depositor can either confirm the end of the pending transaction or abort it. In case of confirmation, all bank notes contained in the escrow ZK are transported along the transport channels 18, the diverting point 17 and the further transport channel 19 to an end cashbox EK located below the basic module 2 in a safe, where the bank notes are finally stored in an associated cassette. The amounts deposited and stored in the end cashbox are then credited to an account assigned to the depositor.

If the pending transaction is otherwise aborted by the depositor, all bank notes already contained in the escrow ZK are transported along the transport channels 18, 11 and 12 to the transport path $S_4$ for reoutput of the bank notes onto the delivery surface 15 of the pocket 3.

Unlike the embodiment of such a cash deposit apparatus described in DE 102 10 687 A1, the apparatus 1 of the present invention as shown in FIG. 1 is characterized by having a light barrier 20 immediately after the aligning path $S_1$ for monitoring the passing run of the bank notes aligned by the alignment unit 5. In the described variant, the light barrier 20 is preferably directly upstream of the checking unit 6 in order e.g. to be able to control the sensor elements of the checking unit 6 in dependence on the actual position of the arriving bank notes as detected by the light barrier 20.

Since the light barrier 20 is mounted in this position and not for example already in or before the alignment path $S_1$, it is also possible to avoid errors in the recognition of those bank notes having see-through windows. Due to the lack of alignment before traversal of the aligning path $S_1$, such bank notes might in some cases not be detected correctly by a light barrier disposed in the singler or in the aligning path $S_1$ because a light barrier disposed there might possibly transilluminate precisely the see-through area.

Alternatively or in addition, it is also conceivable that a plurality of light barriers are disposed perpendicular to the transport direction such that at least one of the light barriers does not shine through the see-through window. Alternatively, it is also possible to use a light wavelength in which the see-through film is not, or only weakly, transparent. In these cases the light barriers can also already check the position of the bank notes before or during alignment.

A further difference of the inventive apparatus 1 in comparison with DE 102 10 687 A1 is that the diverting device, i.e. the gate module 8 here, itself has means to be able to divert even poor-quality bank notes without jamming.

Figure 2:
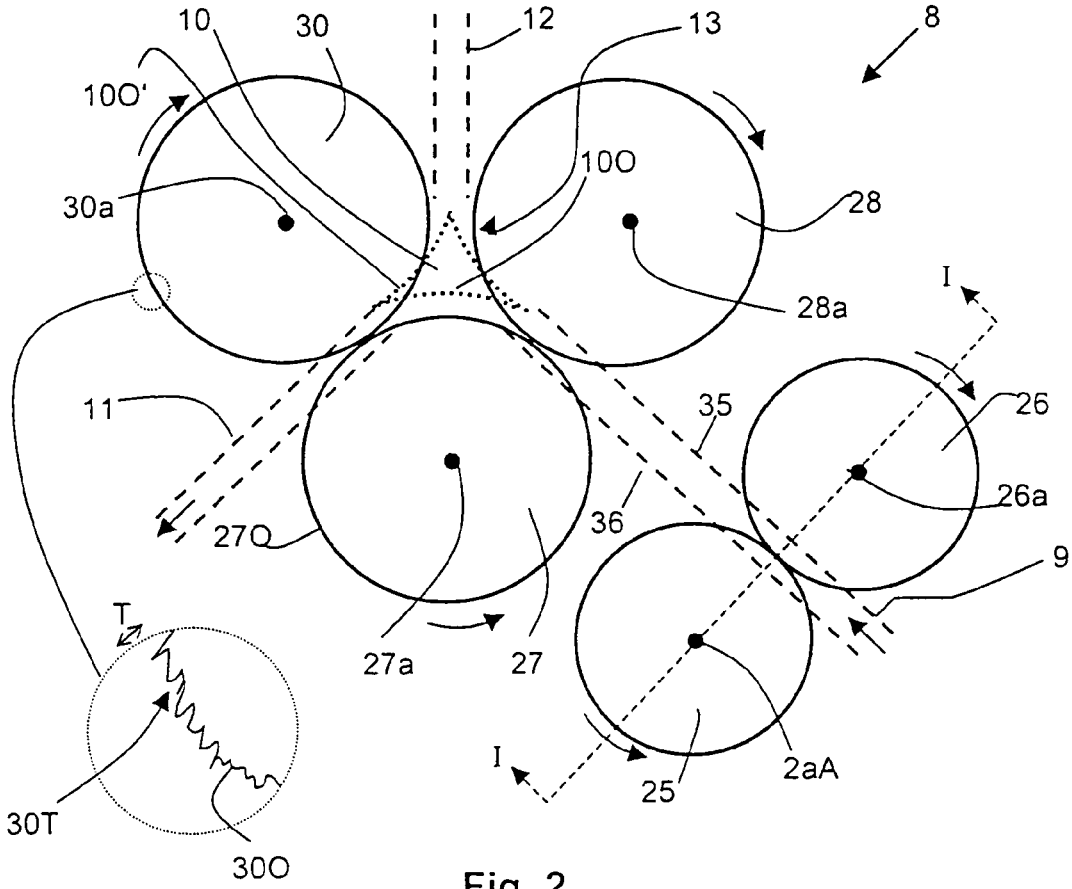
FIG. 2 a schematic cross-sectional view through part of a gate module of the cash deposit apparatus of FIG. 1.

FIG. 2 shows part of the gate module 8 in a schematic view. Three transport channels 9, 11, 12 leading to the diverting point 13 are formed by spaced guiding surfaces 35, 36, whereby from opposite sides pairs of transport rollers 25, 26 mesh through associated apertures. By rotation of the transport rollers 25, 26 around their respective axles 25*a*, 26*a* the bank notes are conveyed through between the transport rollers 25, 26. For clarity's sake, FIG. 2 shows only the transport rollers 25, 26 of the transport channel 9, although they are also present in the other transport channels 11, 12 for supplying and removing the bank notes to be diverted or already diverted.

The bank notes conveyed by the transport rollers 25, 26 within the transport channel 9 then come into the area of the diverting point 13 where the bank notes are grasped by opposite wheels 27, 28 which comb the transport channel 9. The rotation of the wheels 27, 28 around their respective axles 27*a*, 28*a* in the direction shown by arrows in FIG. 2 causes the bank notes to be urged against the curved surface 10O of the gate vane 10 and to be diverted along said surface 10O toward the transport channel 11, in which they are again transported, by the action of the rollers 27 and 30 touching each other and combing the transport channel 11, through the channel 11 to the second diverting point 17.

In the specific example of FIG. 2, the gate module 8 thus has as diverting elements in particular, on one side, the roller 27 and, on the opposite side, the rollers 28 and 30 between which the bank notes are transported and diverted by the gate element 10.

Although not restricted thereto, it is advantageous for avoiding torques on the diverted bank notes if a plurality of rollers are in each case mounted on the axles 25*a*, 26*a*, 27*a*, 28*a* and 30*a*. In the area between two rollers on an axle a gate vane 10 will preferably be disposed in each case. That is, the gate vane 10 of FIG. 2 shown by dotted lines is actually offset in a different plane from the rollers 25, 26, 27, 28 and 30, regarded in a direction perpendicular to the sheet plane of FIG. 2. The individual gate vanes can engage between the particular rollers 27, 28, 30 on the axles 27*a*, 28*a*, 30*a* and are preferably rigidly interconnected to be able to be displaced jointly.

The diverting device, i.e. the gate module 8 of FIG. 2, is characterized in particular by at least the roller 30 having a surface produced so as to be roughened. As can be seen in the detail of the surface 30O of the roller 30 shown enlarged in the left lower half of FIG. 2, the surface 30O has depressions 30T having at least a depth T of 1 mm, preferably 2 mm. Such a structure can be obtained chemically, mechanically or optically, for example by an etching operation or by finishing the surface 30O using laser radiation.

An advantage of said roughened, i.e. unevenly profiled, surface in comparison with normally used rollers having a smooth surface is that the bank notes are grasped and diverted more reliably. The bank note coming from the roller nips between the rollers 25, 26 and 27, 28 hits with its leading edge the roller 30. The surface depressions 30T thereof cause the leading edge to be grasped and drawn into the feed area of the roller nip of the rollers 27 and 30.

On the one hand, it can be provided that all rollers 27, 28, 30 have a thus roughened surface in the area of the diverting point 13. Alternatively, it can also be provided that, of the rollers 27, 28, 30, only the rollers 28, 30 adjacent the diverting surface 100 of the gate vane 10 have such a rough surface.

If a plurality of rollers 27, 28 or 30 are in each case present on the axles 27*a*, 28*a* or 30*a*, and gate vanes 10 in each case in the interjacent areas, another of the rollers 27 or 28 can otherwise also have such a roughened surface in another plane, while the remaining rollers 27 and 30 or 28 and 30 have a smooth surface in said plane. When the bank note is to be diverted for example from the transport channel 11 to the transport channel 12, which involves mechanical displacement of the gate vane 10, particularly the roller 28 can have a roughened surface e.g. in a plane different from the sheet plane, since in this position of the diverting surface, i.e. in this gate vane position of the surface 10O' of the gate vane 10, the leading edge of the bank note to be diverted precisely hits onto said roller 28.

Figure 3:
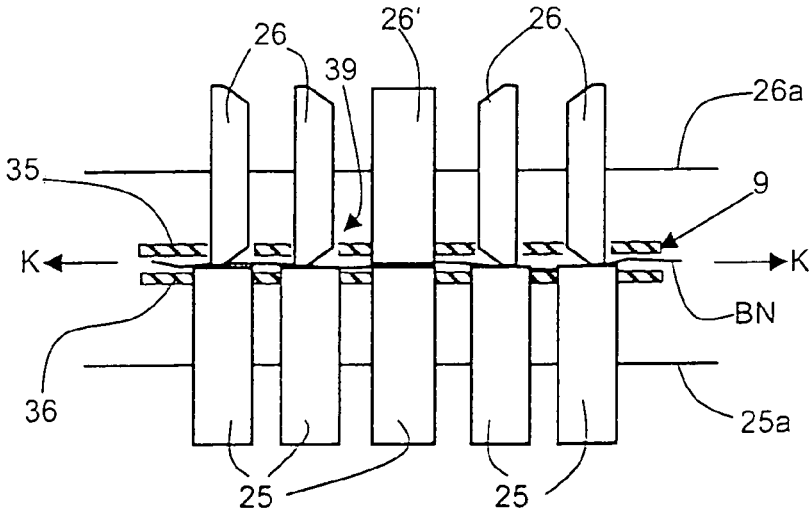
FIG. 3 a cross section along the line I-I of FIG. 2.

The gate module 8 of FIG. 2 of the present invention differs from the known gate module according to DE 102 10 687 A1 additionally by the construction of the transport rollers 25, 26 for supplying the bank notes to the diverting point 13. Their cross section along the line I-I of FIG. 2 is shown schematically in FIG. 3.

As already mentioned above, a plurality of spaced-apart transport rollers 25, 26 are rotatably mounted on axle 25*a* and 26*a*, respectively, which, meshing in pairs, engage associated gaps of the guidance faces 35, 36 of the transport channel 9. The rollers 26 on one side of the transport channel 9 are characterized by being beveled in the area coming in contact with the opposite rollers 25. The rollers 26 are preferably of conical or frustoconical form.

It is not absolutely necessary for all rollers applied to the axle 26*a* to have said conical embodiment. However, rollers 26 on the left side of the roller 26' must have a different inclination from rollers 26 on the right side of the roller 26'. Since the inclined face of the conical surface is now reversed on the rollers 26 mounted on the left of said roller 26' compared to the rollers 26 on the other side, it is achieved that the surface areas of the rollers 26 are deformed outwardly due to the elastic deformation of the rollers 26 during transport of a bank note BN through between the rollers 25, 26, thereby causing at least the leading edge of the bank note BN transported past to be pulled apart, as indicated by the arrows K in FIG. 3. This tightening of the leading edge immediately before it runs into the diverting point 13 leads to a considerably reduced number of jams in the otherwise especially jam-prone gate module 8.

Although an active mechanical displacement of the axles 25*a* or 26*a* with respect to each other is also advantageous in order to control in defined fashion the deformation of the rollers 26 and thus the associated dynamic effect on the bank notes BN, this effect can also be obtained without active displacement of the axle 25*a*, 26*a* at a fixed distance of the axles 25*a* and 26*a* if the deformation of the surface of the rollers 26 is effected by the bank note BN itself running in between the opposite rollers 25, 26 located in contact.

Figure 4:
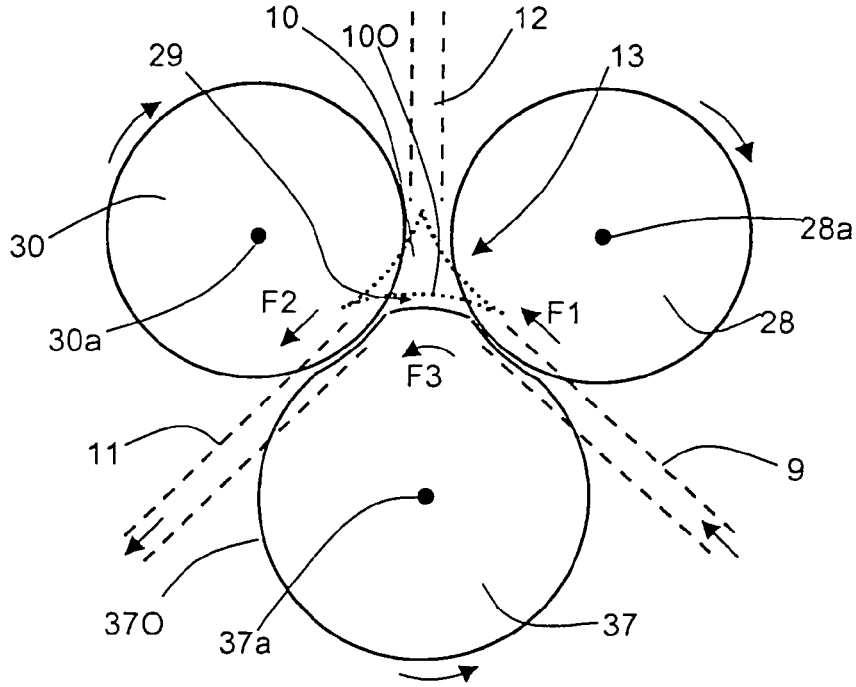
FIG. 4 an alternative structure of the gate module of FIG. 2.

Besides the above-described variants, further modifications are of course possible. FIG. 4 illustrates an alternative means for preventing jams during diversion of sheets in the gate module 8. The representation corresponds substantially to that of FIG. 2, whereby the transport rollers 25, 26 basically of course also present in this case for supplying bank notes to the diverting point 13 are omitted merely for clarity's sake.

In comparison with the variant according to FIG. 2, in which the diverting elements, i.e. at least the roller 27, has a roughened surface, the corresponding diverting roller 37 according to FIG. 4 is characterized by being formed either completely or at least in a surface area from an elastic material which is deformed complementarily to the form of the opposite diverting rollers 30, 38 upon rotation around the axle 37*a*. The diverting rollers 28, 30 are formed from a hard material that is not significantly deformed by the action of the roller 37. The roller 37 is mounted rotatably around the axle 37*a*.

The material of the roller 37 is selected so as to be deformed significantly in the contact area with the opposite rollers 28, 30 having a harder surface. The material used for the roller 37 can be for example a foam material, such as a PUR soft foam, e.g. made of polyester or polyether.

The use of the elastic roller 37 firstly increases the contact surface with the opposite rollers 28, 30. Moreover, the deformation of the elastic roller 37 between the opposite hard rollers 28, 30 causes the gap 29 between the surface 10O of the gate vane 10 and the surface 37O of the roller 37, regarded in a direction perpendicular to the sheet plane, to be reduced, or actually causes a meshing of the surfaces 10O, 37O of the axially tandem roller 37 with the gate vane 10. By the rotation of the roller 37 this not only causes a force F1 or F2 to be exerted at the contact points of the rollers 37 and 28 or 37 and 30, but also an additional feed force F3 in the area of the surface 10O of the gate vane 10 along which the bank note is guided for diversion. This supports a reliable diversion of the transported bank notes at the diverting point 13.

It should be emphasized that the elastic roller 37, measured in a non-deformed state, preferably has a larger radius than the opposite rollers 28, 30 to thereby increase the stated effect further.

Figure 5:
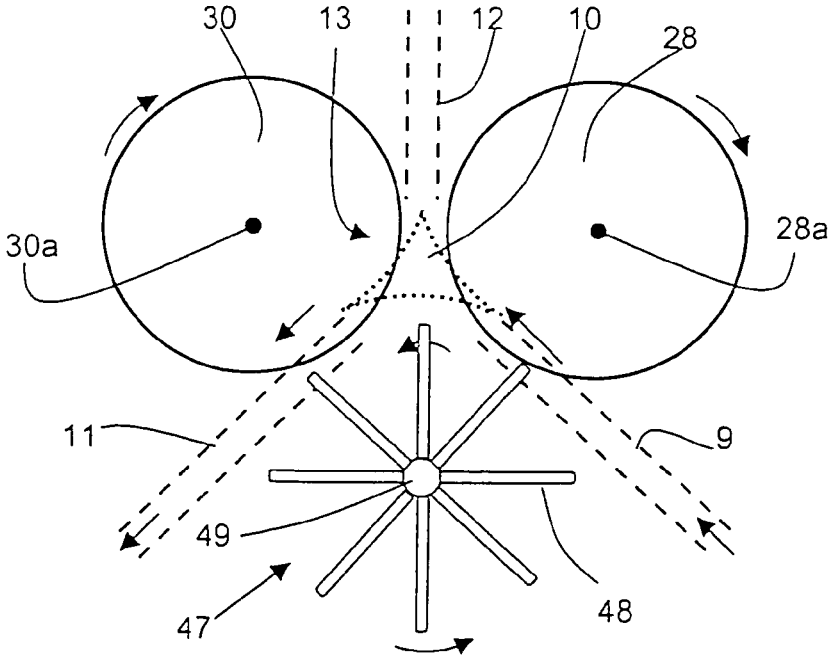
FIG. 5 a further alternative structure of the gate module of FIG. 2.

A further alternative to the embodiments according to FIGS. 2 and 4 is shown in FIG. 5, whose view corresponds substantially to that of FIG. 4. Unlike the embodiment according to FIG. 4, the variant according to FIG. 5 has, instead of the roller 37 with a deformable surface 37O, a paddle wheel 47 having a plurality of radially disposed paddle vanes 48. The paddle vanes 48 are flat metal plates 48 mounted radially on the cylindrical axle 49.

Since the diverting element used is now not a roller 27 or 37 but a paddle wheel 47 with vanes 48, it can be achieved that by rotation of the paddle wheel 47 around its axle 49 the sheet material to be diverted arriving in the transport channel 9 is pulled along in the transport channel 9 toward the diverting point 13 by the vanes 48 acting on the sheet material.

This again permits even bank notes in poor condition to be conveyed through the diverting point 13 particularly reliably. The rotation of the paddle wheel 47 is preferably synchronized with the time of arrival of the next bank note to be diverted in the transport channel 9, said time being optionally detected by a light barrier, in order to prevent the incoming bank note from hitting the tips of one of the stacker fingers 48 and a jam being caused for precisely that reason.

It should be emphasized that the above-mentioned variants for avoiding jams in the diverting device 8 can also be used independently or in combination with each other. If a plurality of diverting elements, such as rollers 27 or paddle wheels 47, are in each case mounted on a common axle perpendicular to the transport direction, it is additionally possible to use conventional hard rollers with a smooth surface that are not specially designed for the inventive avoidance of jams and are described e.g. in DE 102 10 687 A1. Moreover, it is not absolutely necessary to use rollers for transporting or diverting the bank notes; transport by endless belts is also fundamentally possible.

Since a diverting device located in the transport path itself thus has means for transporting even poor-quality sheets through between diverting elements of the diverting device without jamming, and/or a transport monitoring of the position of the sheets in the transport path is carried out only after traversal of an alignment unit, a particularly reliable operation of the processing apparatus with a low probability of jams and malfunctions is possible.

The invention claimed is:

1. An apparatus for processing sheet material, comprising a transport device for transporting single sheets of the sheet material, the transport device including a diverting device for diverting the transport direction of the single sheets, the diverting device comprising one or more opposite first and second diverting elements between which the sheets are transported through for diversion, and wherein the diverting device comprises means for transporting sheets between the diverting elements without jamming;

wherein at least one of the diverting elements has a roughened surface with depressions of at least 1 mm.

2. The apparatus according to claim 1, wherein the diverting device is a separate component of the apparatus.

3. The apparatus according to claim 1, wherein at least some of either of or both the first and second diverting elements comprise diverting rollers which are each mounted rotatably around an axle.

4. The apparatus according to claim 1, wherein the first diverting element rotates for diverting the sheet material, and the first diverting element has an elastic surface which, upon rotation, is deformed complementarily to the form of the second diverting element.

5. The apparatus according to claim 1, wherein either of or both the first and second diverting element has a paddle wheel with outwardly protruding paddles arranged to pull along the sheet material, by rotation of the paddle wheel, toward a point in the transport path of the diverting device where the sheet material is diverted.

6. The apparatus according to claim 1, wherein the diverting device is a transport gate, arranged so that mechanical displacement of a gate element permits the sheets to be diverted alternatively into different transport paths.

7. The apparatus according to claim 6, wherein the gate element and the other diverting elements are disposed in different planes.

8. An apparatus for processing sheet material, comprising a transport device for transporting single sheets of the sheet material, the transport device including a diverting device for diverting the transport direction of the single sheets, the diverting device comprising one or more opposite first and second diverting elements between which the sheets are transported through for diversion, and wherein the diverting device comprises means for transporting sheets between the diverting elements without jamming;

the apparatus further including a smoothing device arranged so as to pull apart the sheet material in a direction perpendicular to the transport direction immediately before diversion in the diverting device.

9. The apparatus according to claim 8, wherein the smoothing device is part of the diverting device.

10. The apparatus according to claim 8, wherein the smoothing device comprises conically formed pressure rollers with an elastic surface.

* * * * *

UNITED STATES PATENT AND TRADEMARK OFFICE

CERTIFICATE OF CORRECTION

PATENT NO. : 7,624,982 B2
APPLICATION NO. : 10/577244
DATED : December 1, 2009
INVENTOR(S) : Christl et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 404 days.

Signed and Sealed this

Twenty-first Day of December, 2010

David J. Kappos

David J. Kappos
*Director of the United States Patent and Trademark Office*